United States Patent [19]

Faucz

[11] 4,060,811

[45] Nov. 29, 1977

[54] MAGNETIC LATENT IMAGE CREATION

[75] Inventor: Eugene C. Faucz, Webster, N.Y.

[73] Assignee: Xerox Corporation, Stamford, Conn.

[21] Appl. No.: 662,628

[22] Filed: Mar. 1, 1976

[51] Int. Cl.[2] ..... G03G 19/00

[52] U.S. Cl. ..... 346/74.1; 360/57

[58] Field of Search ..... 346/74.1, 74 ES; 360/57

[56] References Cited

U.S. PATENT DOCUMENTS

| | | | |
|---|---|---|---|
| 2,793,135 | 5/1957 | Sims, Jr. | 346/74.1 |
| 2,959,638 | 11/1960 | Sims, Jr. | 346/74.1 |
| 3,120,806 | 2/1964 | Supernowicz | 346/74.1 |
| 3,541,573 | 11/1970 | Ault | 360/57 |
| 3,665,484 | 5/1972 | Foster | 346/74.1 |
| 3,740,216 | 6/1973 | Goffe | 346/74.1 |
| 3,844,907 | 10/1974 | Kitamoto | 346/74.1 |

*Primary Examiner*—Jay P. Lucas

*Attorney, Agent, or Firm*—James J. Ralabate; Richard A. Tomlin; George J. Cannon

[57] ABSTRACT

Process and apparatus for creating a magnetic latent image capable of being rendered visible with magnetic toner without image deletion. An area of interest on a magnetizable member is recorded with a first substantially uniform spatial pattern of magnetic transitions having a transition wavelength $\lambda_1$ capable of retaining magnetic toner on the magnetizable member and effective to substantially completely cover the area of interest upon development with magnetic toner. A second spatial pattern of magnetic transitions having a transition wavelength $\lambda_2$ is then recorded in the area of interest in one of imagewise and background configuration; the second spatial pattern of magnetic transitions having a transition wavelength $\lambda_2$ incapable of retaining said magnetic toner on said magnetizable member, wherein $\lambda_1$ is greater than $\lambda_2$ thereby effectively selectively "erasing" the first spatial pattern of magnetic transitions with respect to visible developability with magnetic toner.

15 Claims, 3 Drawing Figures

MAGNETIC LATENT IMAGE CREATION

BACKGROUND OF THE INVENTION

This invention relates to magnetic imaging and more particularly, to method and apparatus for creating an improved latent image on a magnetizable member.

There has recently been introduced a magnetic imaging system which employs a latent magnetic image on a magnetizable member which can then be utilized for purposes such as electronic transmission or in a duplicating process by repetitive magnetic toning and transfer of the developed magnetic latent image. Such latent magnetic image is provided by any suitable magnetization procedure whereby a magnetized layer of marking materials is magnetized, such magnetism transferred imagewise to the magnetic substrate. Such a process is more fully described in U.S. Pat. No. 3,804,511 to Rait et al. Such a process requires the utilization of an original image, creating a duplicate of the original image in magnetizable marking material, magnetizing the magnetizable marking material, and then transferring the signal from the magnetized marking material to a magnetizable member.

In magnetic recording systems conventional to audio and visual recording systems, the magnetic signal is recovered by an electronic "reading" head which reconstructs the desired signal into an appropriate audio or visual electronic signal. These conventional systems depend upon recording the magnetic signals on magnetizable member in "tracks" which are separated from one another by spacings or "guard bands" of the magnetizable member surface bearing no magnetic signal. These "guard bands" are absolutely necessary so that the "reading" head can accurately reconstruct the desired magnetic signal from the "track" that it is reading without being affected by the fringing magnetic fields from adjacent tracks.

In an imaging system wherein the magnetic latent image is desirably rendered visible with magnetic toner, as opposed to the conventional audio and visual magnetic recording systems, the presence of "guard bands" are highly undesirable because magnetic toner is not attracted thereto. This phenomenon is detrimental to visible imaging schemes relying upon magnetic marking materials to develop a magnetic latent image since it leads to streaks or image deletions, especially in solid areas, upon development of the magnetic latent images.

Furthermore, amplitude modulated recording conventional to audio magnetic recording and disclosed in U.S. Pat. Nos. 3,013,124; 3,479,036 and 3,275,757 are not desirable for visible development of magnetic latent images. This is so because latent magnetic images for visible development is characterized by very high gamma and little or no "gray" scale can be obtained by using an amplitude varying signal. Accordingly, an amplitude modulated magnetic image would result in loss of good solid area coverage upon development with a magnetic marking material.

The present invention provides an improved magnetic latent image capable of being rendered visible with magnetic marking material without image deletion.

SUMMARY OF THE INVENTION

Therefore, an object of this invention is to provide a magnetic latent image which overcomes the above deficiencies.

Another object of this invention is to provide a novel method for creating a magnetic latent image capable of being rendered visible with magnetic marking material without image deletion.

Another object of this invention is to provide apparatus for creating a magnetic latent image upon a magnetizable member which is capable of being rendered visible with magnetic marking material without image deletion.

In accordance with the present invention, there is provided method and apparatus for creating a magnetic latent image capable of being rendered visible with magnetic marking materials without image deletion. This is accomplished by uniformly prerecording the entirety of an area of interest on a magnetizable member in which area it is desired to place the magnetic latent image. The uniform recording comprises a uniform spatial pattern of magnetic transitions over the entire area of interest, the spatial pattern having a transition wavelength capable of retaining magnetic toner on the magnetizable member. If the uniform spatial pattern over the entire area of interest were to be developed at this point, the magnetic marking material would completely cover the area of interest due to the uniformity of the spatial pattern of magnetic transition. However, prior to development, a second spatial pattern of magnetic transitions is created within the area of interest in either imagewise or background configuration; the second spatial pattern of magnetic transitions having a wavelength incapable of retaining magnetic marking material on the magnetizable member because the magnetic forces emanating from the second spatial pattern are too small to retain toner. Accordingly, with respect to rendering the first spatial pattern visible with magnetic marking material, the first spatial pattern is "erased." The portion of the first spatial pattern which is not so "erased" with respect to developability by magnetic marking material is, upon development, completely covered with magnetic marking material thereby providing images with no image deletion and with good solid area coverage.

DETAILED DESCRIPTION OF THE PREFERRED EMBODIMENTS

Figure 1A:
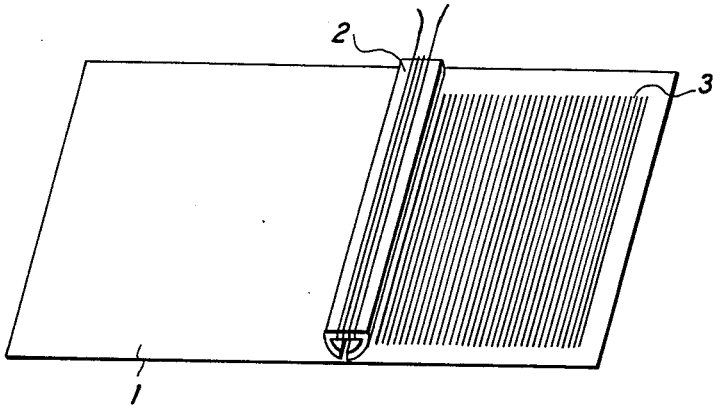
FIG. 1A is a schematic illustration of the preferred embodiment of recording a first uniform spatial pattern of magnetic transition for an entire area of interest.
Figure 2:
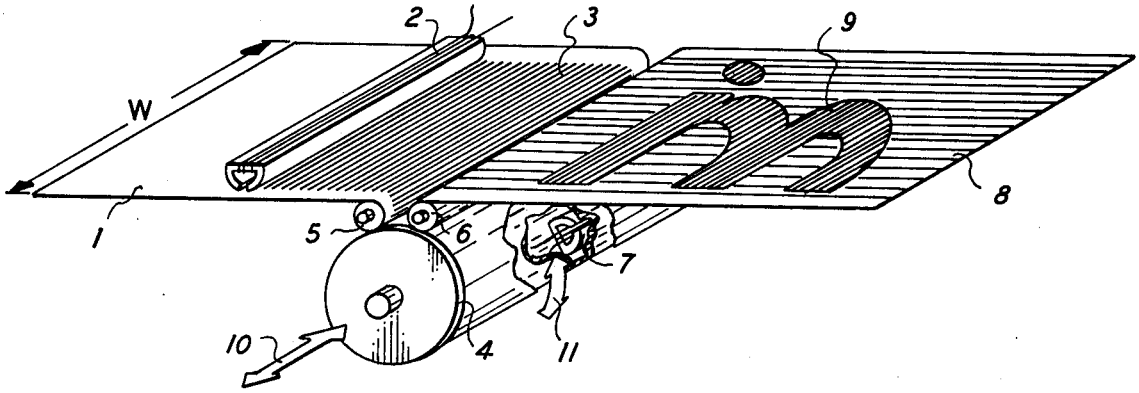
FIG. 2 is a schematic illustration of apparatus preferred for the practice of the present invention.

Referring now to FIG. 1A, there is schematically illustrated a recording head 2 recording a first uniform spatial pattern of magnetic transitions upon magnetizable member 1. As depicted in FIG. 1A, recording head 2 is preferably as long as the area of interest is wide, thereby providing in a simple and direct manner the uniform spatial pattern 3 of magnetic transition over the entire area of interest. For example, in magnetic imaging devices which are to be utilized for copying an original image, the area of interest is conveniently selected to be of the same dimensions as the original document. That is, 8 ½ inches by 11 inches or other conventional paper dimensions. Recording head 2 can be replaced by a plurality of recording heads of smaller lengths so long as the spatial pattern of magnetic transitions formed over the entire area of interest on the magnetizable member 1 is substantially uniform. The use of a plurality of smaller recording heads to provide the spatial pattern 3 requires extremely close tolerances to ensure that the track formed by each of the recording heads is in phase with the tracks produced by all of the other recording heads. Accordingly, although the present invention is broad enough to encompass the use of a plurality of recording heads to form spatial pattern 3, the preferred embodiment is depicted in FIG. 1A and FIG. 2, wherein a single recording head is utilized.

Recording head 2 can be driven by alternating current or by direct current appropriately coupled directly to the recording head. For purposes of describing spatial pattern 3, assume that recording head 2 is driven by alternating current. The frequency of alternating current applied to recording head 2, the speed of relative movement between magnetizable member 1 and record head 2 and the identity of the magnetizable material in magnetizable member 1 are inter-related in producing the desired spatial pattern 3. A convenient starting point is to experimentally determine by readily available means the transition wavelength for the magnetic material in member 1 below which magnetic marking material is not retained on member 1. For chromium dioxide as the magnetic material in member 1, commercially available under the tradename Crolyn from E. I. DuPont de Nemours, Inc., it was experimentally determined that magnetic marking material, including dry magnetic toner and magnetic ferrofluids, would not be retained on member 1 when the transition wavelength of spatial pattern 3 was less than about 5 microns. Accordingly, when magnetizable member 1 comprises chromium dioxide, it is desired to have a transition wavelength greater than 5 microns in areas to be developed. Magnetization wavelengths from about 10 to about 100 microns are preferred for optimum developability with magnetic marking material. However, wavelengths below 10 microns and in excess of 100 microns will render latent magnetic images visible upon development with magnetic marking materials.

Assuming, therefore, that the minimum transition wavelength has been identified for the magnetic material in magnetizable member 1, the speed of relative movement between member 1 and record head 2 are adjusted to provide a wavelength at least equal to or greater than the minimum wavelength. Again, assuming member 1 to comprise chromium dioxide, the minimum transition wavelength of about 5 microns is achieved so long as a ratio of A.C. frequency in Hz to speed of relative movement in inches per second is equal to or greater than about 5000.

The phrase "wavelength" is used herein in the conventional sense to mean the spatial wavelength on the magnetizable member 1 occupied by the two magnetic transitions produced by recording head 2 for each cycle of alternating current. Thus, a magnetic transition occurs along the tape at each interval equal to one-half the transition wavelength.

Figure 1B:
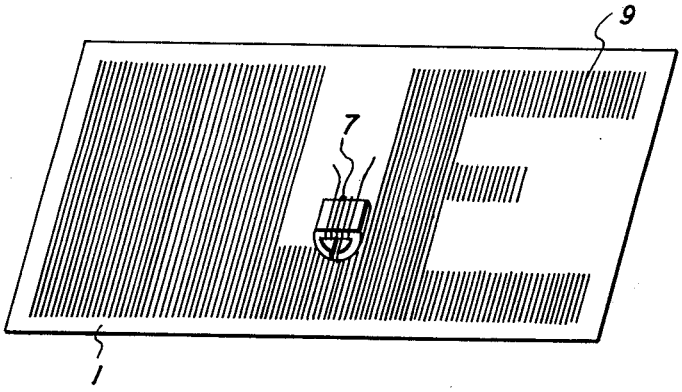
FIG. 1B is a schematic illustration of "erasing" the first spatial pattern of magnetic transitions by recording within the area of interest a second spatial pattern of magnetic transitions.

Referring now to FIG. 1B, there is schematically illustrated the "erase" head 7 which, in actuality, is a recording head recording a second spatial pattern of magnetic transitions within member 1 in the area of interest and hence over spatial pattern 3. Head 7 has a width much less than that of record head 2 which is selected with regard to the scan line density desired. For example, a head width of about two mil for head 7 will provide a scan line density of about 500 lines per inch. Head widths of from about 1 to about 3 mil are entirely satisfactory for head 7 and widths below and above this range can be utilized as desired. Head 7 can record the second spatial pattern in the area of interest in any direction including the directions parallel and orthogonal to the magnetic transitions in spatial pattern 3. The transition wavelength of the spatial pattern of magnetic transition produced by head 7 must be sufficiently small with regard to the magnetic materials and member 1 that magnetic marking material will not be retained on member 1 in areas thereof recorded by head 7. Again, as an example, if member 1 comprises chromium dioxide then the transition wavelength produced by head 7 should, of course, be less than about 5 microns. Accordingly, the ratio of A.C. frequency to head 7 in Hz to the speed of relative movement between member 1 and head 7 in inches per second is kept below 5000. Accordingly, a condition of the practice of the present invention is that the transition wavelength of the second spatial pattern provided by head 7 is incapable of retaining magnetic marking material on member 1 and is less than the transition wavelength of the fist spatial pattern of magnetic transitions produced by record head 2 and, that the transition wavelength of the first spatial pattern of magnetic transitions is capable of retaining magnetic marking material on member 1.

Referring now to FIG. 2, there is schematically illustrated a preferred apparatus for practicing the present invention in a magnetic imaging device. As seen in FIG. 2, magnetizable member 1 passes over engage means 5 around mandril 4, over engage means 6 and continues along its path of travel. Record head 2 is depicted as having a length substantially equal to the width W of magnetizable member 1. This will ensure the simple, convenient formation of spatial pattern 3 of magnetic transitions over the entire area of interest on member 1. For example, if the area of interest were coextensive with an original document having dimensions of 8 ½ inches by 11 inches, relative movement between member 1 and record head 2 is effected so that the dimensions of spatial pattern 3 is at least 8 ½ inches by 11 inches.

The diameter of mandril 4 is selected to provide a circumference sufficient to allow scanning of the complete area of interest by head 7 which is mounted in the mandril. Mandril 4 is driven by conventional drive means in rotation clockwise or counterclockwise in the directions of arrow 11. When mandril 4 is rotated counterclockwise, spatial pattern 3 is advanced around the circumference of mandril 4 when engage means 5 and 6 are brought into contact with member 1. When the engage means 5 and 6 are disengaged from member 1, advancement of member 1 ceases. Similarly, when mandril 4 rotates in a clockwise direction, member 1 is selectively retreated by engagement means 5 and 6. Optionally, mandril 4 can be translated in the directions of arrow 10 to move member 1 in a back and forth motion relative to head 7. Head 7 is rotatably mounted to scan member 1 in the directions of arrow 11. Optionally, head 7 can be provided with translations in the directions of arrow 10. The drive means for imparting the rotational and translational motion to mandril 4 and record head 7, and the selective engage means 5 and 6 are well known and conventional to the art and need not be described in further detail herein. The "track" width 8 schematically illustrates the typical record head width of head 7. Magnetic latent image 9 is schematically illustrated in FIG. 2 and represents that portion of spatial pattern 3 which is not recorded over by head 7.

Other modifications and ramifications of the present invention will occur to those skilled in the art upon a reading of the present disclosure. These are intended to be included within the scope of the present invention.

For example, it will be appreciated that relative movement between member 1 and heads 2 and 7 can be provided by moving member 1 with respect to the heads, or moving the heads with respect to member 1, or by moving both with respect to one another.

Further, it will be appreciated that the invention can be practiced with magnetizable members of any conventional magnetic recording composition including iron oxide, chromium dioxide and magnetite.

What is claimed is:

1. A method for creating a magnetic latent image capable of being rendered visible with magnetic toner without image deletion, comprising:

a. recording over an entire area of interest on a magnetizable member a first substantially uniform spatial pattern of magnetic transitions having a transition wavelength $\lambda_1$ capable of retaining said magnetic toner on said magnetizable member and effective to substantially completely cover said area of interest upon development with magnetic toner; and b. recording in one of imagewise and background configuration within said area of interest a second spatial pattern of magnetic transitions having a wavelength $\lambda_2$ incapable of retaining said magnetic toner on said magnetizable member, wherein $\lambda_1 > \lambda_2$.

2. The method according to claim 1 wherein said second spatial pattern of magnetic transitions is recorded in imagewise configuration.

3. The method according to claim 1 wherein said second spatial pattern of magnetic transitions is recorded in background configuration.

4. The method according to claim 1 wherein said magnetizable member comprises chromium dioxide.

5. The method according to claim 4 wherein said second spatial pattern of magnetic transitions has a wavelength $\lambda_2 \leqq$ about 5 microns.

6. The method according to claim 4 wherein step (a) is performed by moving one or both of the magnetizable member and an alternating current recording head relative to the other, the ratio of A.C. frequency in Hz to speed of movement in inches per second being < about 5000.

7. The method according to claim 1 wherein step (b) is performed by moving one or both of the magnetizable member and an alternating current recording head relative to the other, the ratio of A.C. frequency in Hz to speed of movement in inches per second being $\geqq$ about 5000.

8. The method according to claim 1 wherein said recording steps (a) and (b) comprises an alternating current signal.

9. The method according to claim 1 wherein said recording steps (a) and (b) comprises a direct current signal.

10. Apparatus for creating on a magnetizable member a magnetic latent image capable of being rendered visible with magnetic toner without image deletion, comprising:

a. first recording means for single pass recording over the substantial entirety of one side of said magnetizable member a first substantially uniform spatial pattern of magnetic transitions having a transition wavelength $\lambda_1$, capable of retaining said magnetic toner on said magnetizable member and effective to substantially completely cover said one side upon development with magnetic toner; and b. second recording means for recording one of imagewise and background configuration a second spatial pattern of magnetic transitions having a wavelength $\lambda_2$ incapable of retaining said magnetic toner on said magnetizable member, wherein $\lambda_1 > \lambda_2$.

11. The apparatus of claim 10 wherein said first and second recording means comprise alternating current recording heads.

12. The apparatus of claim 11 further including means for maintaining a ratio of A.C. frequency in Hz to relative magnetizable member speed in inches per second of < about 5000 at the first recording means location and $\geqq$ about 5000 at the second recording means location.

13. The apparatus of claim 10 further including means for selectively moving said magnetizable member relative to said first and second recording means.

14. The apparatus of claim 10 further including means for selectively moving said first recording means relative to said magnetizable member.

15. The apparatus of claim 10 further including means to move said second recording means relative to said magnetizable member.

* * * * *

UNITED STATES PATENT AND TRADEMARK OFFICE

CERTIFICATE OF CORRECTION

PATENT NO. : 4,060,811

DATED : November 29, 1977

INVENTOR(S) : Eugene C. Faucz

It is certified that error appears in the above-identified patent and that said Letters Patent are hereby corrected as shown below:

Column 3, lines 53-54, "equal to or greater than about" should read --kept below--.

Column 4, line 19, "kept below" should read --equal to or greater than about--.

Signed and Sealed this

*Eleventh* Day of *September 1979*

[SEAL]

*Attest:*

*Attesting Officer*

LUTRELLE F. PARKER

*Acting Commissioner of Patents and Trademarks*